US007437114B2

(12) United States Patent
Kim et al.

(10) Patent No.: US 7,437,114 B2
(45) Date of Patent: Oct. 14, 2008

(54) HEATING ROLLER AND IMAGE FIXING APPARATUS USING THE SAME

(75) Inventors: Hwan-guem Kim, Seoul (KR); Dong-kyun Kang, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 179 days.

(21) Appl. No.: 11/438,071

(22) Filed: May 22, 2006

(65) Prior Publication Data

US 2006/0291925 A1 Dec. 28, 2006

(30) Foreign Application Priority Data

Jun. 27, 2005 (KR) ..... 10-2005-0055546

(51) Int. Cl.
*G03G 15/20* (2006.01)

(52) U.S. Cl. ..... 399/333; 399/330

(58) Field of Classification Search ..... 399/333, 399/330, 328; 219/216, 469; 432/59, 60; 492/46, 53

See application file for complete search history.

(56) References Cited

U.S. PATENT DOCUMENTS

| | | | | |
|---|---|---|---|---|
| 6,347,211 | B2 | 2/2002 | Nanataki | |
| 2003/0086737 | A1 * | 5/2003 | Shida et al. | 399/330 |
| 2004/0047660 | A1 * | 3/2004 | Kim et al. | 399/330 |
| 2004/0120741 | A1 * | 6/2004 | Kim et al. | 399/330 |
| 2004/0141777 | A1 * | 7/2004 | Cho et al. | 399/328 |
| 2004/0253028 | A1 * | 12/2004 | Kim et al. | 399/330 |
| 2005/0129434 | A1 * | 6/2005 | Kim | 399/330 |
| 2005/0142351 | A1 * | 6/2005 | Takagi et al. | 399/333 X |
| 2005/0286926 | A1 * | 12/2005 | Chae et al. | 399/330 X |
| 2006/0121284 | A1 * | 6/2006 | Held et al. | 428/411.1 |
| 2006/0204294 | A1 * | 9/2006 | Tsueda et al. | 399/330 |
| 2006/0291892 | A1 * | 12/2006 | Jang et al. | 399/328 X |

FOREIGN PATENT DOCUMENTS

| | | |
|---|---|---|
| CN | 1510530 | 7/2004 |
| JP | 01-266574 | 10/1989 |
| JP | 2001-147610 | 5/2001 |
| KR | 1992-004916 | 3/1992 |
| KR | 1020020037247 | 5/2002 |
| KR | 1020040055364 | 6/2004 |

* cited by examiner

*Primary Examiner*—Sophia S Chen
(74) *Attorney, Agent, or Firm*—Roylance, Abrams, Berdo & Goodman, L.L.P.

(57) ABSTRACT

A heating roller includes an exterior aluminum pipe preferably coated with a Teflon layer. A primer layer is disposed inside the exterior aluminum pipe. An outer insulating layer is disposed inside the primer layer. A heating coil is disposed inside the outer insulating layer. An inner insulating layer is disposed inside the heating coil. An aluminum interior pipe is disposed inside the inner insulating layer, and has a predetermined expandability. The heating roller is used as an image fixing unit for fixing a developed image on a recording medium while being pressed by a pressing roller at a predetermined pressure.

15 Claims, 4 Drawing Sheets

HEATING ROLLER AND IMAGE FIXING APPARATUS USING THE SAME

CROSS-REFERENCE TO RELATED APPLICATIONS

This application claims the benefit under 35 U.S.C. § 119 (a) of Korean Patent Application No. 2005-55546, filed on Jun. 27, 2005, the entire contents of which are hereby incorporated by reference.

BACKGROUND OF THE INVENTION

1. Field of the Invention

The present invention relates to a heating roller and an image fixing apparatus using the same. More particularly, the present invention relates to a heating roller for preventing slipping of internal structures during the rotation of the roller and an image fixing apparatus using the same.

2. Description of the Related Art

Generally, electrophotographic equipment, such as a copier, a fax machine, and a laser beam printer, is provided with a fixing unit for fixing a toner image that is formed on a recoding medium by an image forming unit at a high temperature and a high pressure. The fixing unit includes a heating roller for generating a high-temperature of heat, and a pressing roller rotating in contact with the heating roller while pressing the heating roller at a predetermined pressure.

Typically, the heating roller has a built-in heater (or heat source), such as a halogen lamp, disposed inside a metal tube, and fixes an image by electric heat from the inside. In this case, however, because the heat source and the surface of the roller are separated from each other, a great loss in heat occurs during the heat transfer process, which results in high power consumption of the heat source.

As an attempt to solve the above-described problem, an improved fixing roller has been developed in recent years. The new fixing roller has an electric resistance heating layer formed near the surface of the roller in which the electric resistance heating layer is used as a heat source for the performance of the fixing roller.

FIG. 1 is a cross-sectional view illustrating the configuration of a conventional heating roller used in a fixing unit for an image forming device.

Referring to FIG. 1, a heating roller 10 includes an exterior pipe 11, a heating coil 12, inner and outer insulating layers 13 and 14, and an interior pipe 15.

The heating coil 12 electrically heats a developed image on the recording medium, and a resistance heating coil is typically used. The heating coil 12 receives power through terminals 16 formed on both ends of the exterior pipe 11.

The exterior pipe 11 is made of aluminum with excellent heat conductibility. As shown in FIG. 1, the exterior pipe 11 is coated with a Teflon coating layer 17 to prevent toner particles from sticking to the surface of the same.

The inner and outer insulating layers 13 and 14 block the migration of an electric current from the heating coil 12 to the surface of the exterior pipe 11 to protect a user from any damages. A layer of mica is widely used as the insulating layer.

The interior pipe 15 is also made of aluminum with excellent heat conductibility. The interior pipe 15 is a means for closely adhering internal structures S, namely, the heating coil 12 and the inner and outer insulating layers 13 and 14 to the exterior pipe 11, and has a predetermined degree of expandability. The interior pipe 15 improves the heat transfer efficiency by ensuring that there is no air gap between the exterior pipe 11 and the internal structures S, so heat from the heating coil 12 is not lost but is fully transferred to the exterior pipe 11. Moreover, the expandability of the interior pipe 15 prevents the internal structures S from slipping from the exterior pipe 11.

However, the expandability of the interior pipe 15 is weakened due to the repetitive thermal expansion of the heating coil. Thus, the internal structures S slip more easily from the exterior pipe 11.

When the internal structures S slip, the heating coil 12 twists because both ends thereof are fixed. In some cases the heating coil is cut off, thereby causing a spark or low heat error.

Accordingly, a need exists for an image fixing apparatus having an improved fixing unit in which elements disposed within a heating roller are substantially prevented from slipping.

SUMMARY OF THE INVENTION

An object of the present invention is to provide a heating roller capable of preventing internal structures, including a heating coil, from slipping from an exterior pipe.

Another object of the present invention is to provide an image fixing apparatus using the above-described heating roller.

A heating roller according to exemplary embodiments of the present invention includes an exterior pipe made of materials with excellent heat conductibility, and is preferably coated with a Teflon layer. A primer layer is disposed inside the exterior pipe. An outer insulating layer is disposed inside the primer layer. A heating coil is disposed inside the outer insulating layer. An inner insulating layer is disposed inside the heating coil. An interior pipe is disposed inside the inner insulating layer, and has excellent heat conductibility and predetermined expandability.

Preferably, the outer and inner insulating layers are Mica layers.

In an exemplary embodiment of the present invention, the primer layer is made of an enamel material, which is selected from a group consisting of polyamide, polyimide, AIW (polyamideimide), and urethane.

Alternatively, the primer layer may be formed of a black paint layer.

Preferably, the heating coil is formed of a nickel-chrome layer.

Preferably, the primer layer is less than or equal to approximately 50 μm in thickness, and includes a silicon-containing group, which binds with silicon (Si) resin contained in the Mica layer at a high temperature.

Preferably, the exterior and interior pipes are made of aluminum.

Another aspect of the present invention provides an image fixing apparatus that includes a heating roller, and a pressing roller that contacts the heating roller with a predetermined pressure, thereby forming a fixing nip portion. The heating roller includes an exterior aluminum pipe preferably coated with a Teflon layer. A primer layer is disposed inside the exterior aluminum pipe. An outer insulating layer is disposed inside the primer layer. A heating coil is disposed inside the outer insulating layer. An inner insulating layer is disposed inside the heating coil. An aluminum interior pipe is disposed inside the inner insulating layer and has a predetermined expandability.

Preferably, the outer and inner insulating layers are Mica layers.

In an exemplary embodiment of the present invention, the primer layer is made of an enamel material, which is selected, from a group consisting of polyamide, polyimide, AIW (polyamideimide), and urethane.

Alternatively, the primer layer may be formed of a black paint layer.

Preferably, the heating coil is formed of a nickel-chrome layer.

Preferably, the primer layer is less than or equal to approximately 50 μm in thickness, and includes a silicon-containing group, which binds with silicon (Si) resin contained in the Mica layer at a high temperature.

Preferably, the exterior and interior pipes are made of aluminum.

Still another aspect of the present invention provides an image fixing apparatus that includes the above-described heating roller, and a pressing roller that contacts the heating roller with a predetermined pressure, thereby forming a fixing nip portion.

In an image forming apparatus including an image fixing apparatus for fixing a developed image on a recording medium according to an exemplary embodiment of the present invention, the image fixing apparatus includes an heating roller, and a pressing roller that contacts the heating roller with a predetermined pressure, and forming a fixing nip portion therebetween, wherein the heating roller includes an exterior aluminum pipe coated with a Teflon layer, a primer layer disposed inside the exterior aluminum pipe, an outer insulating layer disposed inside the primer layer, a heating coil disposed inside the outer insulating layer, an inner insulating layer disposed inside the heating coil, and an aluminum interior pipe disposed inside the inner insulating layer and having predetermined expandability.

Therefore, by using the primer layer to adhere internal structures to the inner surface of the exterior pipe, the internal structures are substantially prevented from slipping even during the rotation of the heating roller.

Other objects, advantages, and salient features of the invention will become apparent from the detailed-description, which, taken in conjunction with the annexed drawings, discloses exemplary embodiments of the invention.

BRIEF DESCRIPTION OF THE DRAWINGS

The above aspects and features of the present invention will be more apparent by describing certain exemplary embodiments of the present invention with reference to the accompanying drawings, in which.

Throughout the drawings, like reference numerals will be understood to refer to like parts, components and structures.

DETAILED DESCRIPTION OF EXEMPLARY EMBODIMENTS

An exemplary embodiment of the present invention is described herein below with reference to the accompanying drawings.

Figure 1:
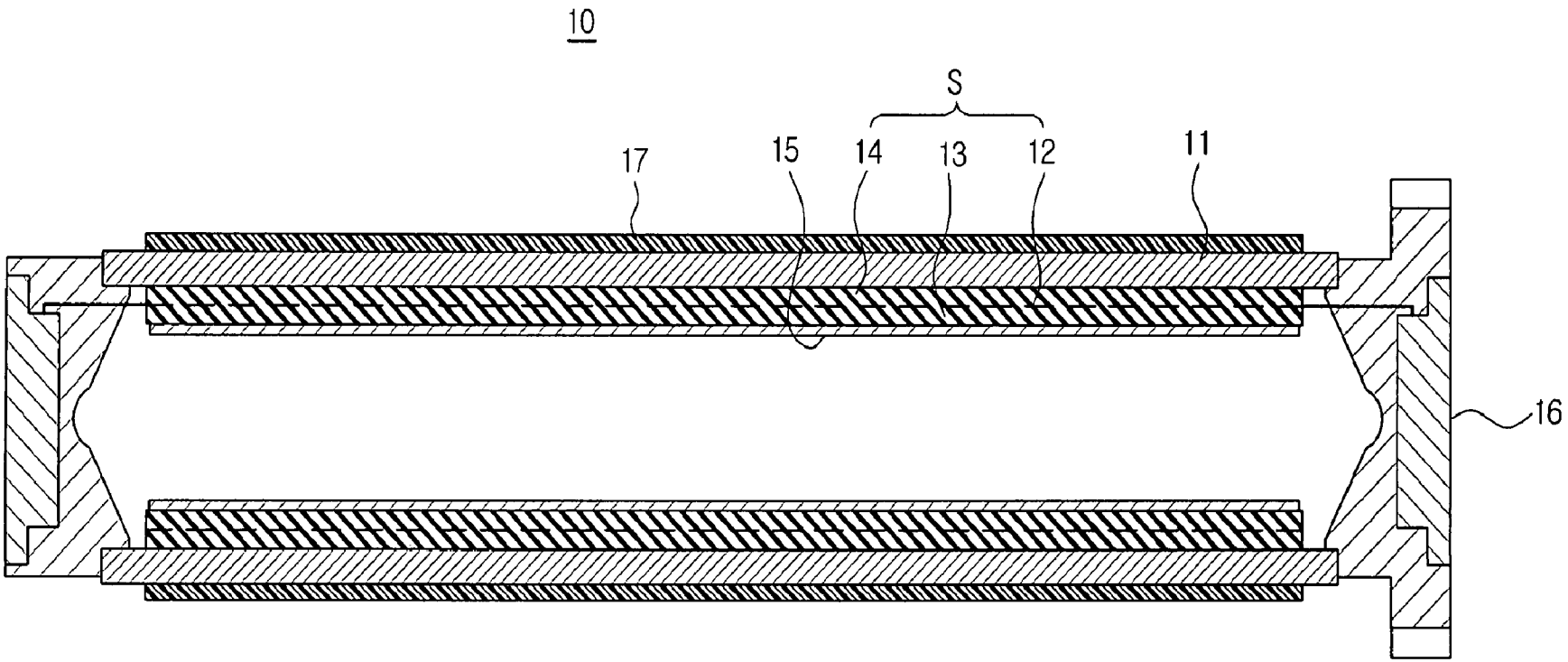
FIG. 1 (PRIOR ART)
FIG. 1 is an elevational view in partial cross section of a conventional heating roller used in a fixing unit for an image forming device.
Figure 2:
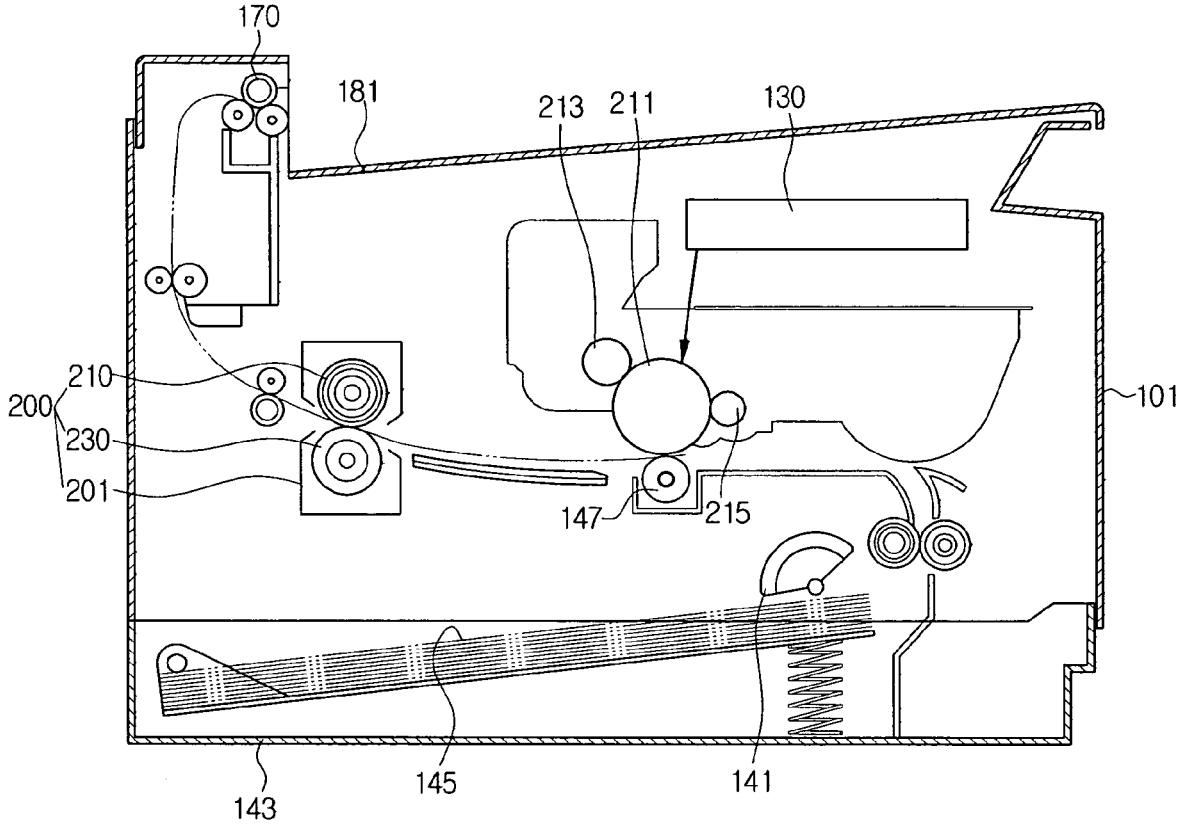
FIG. 2 is a schematic example of an image forming apparatus according to an exemplary embodiment of the present invention.

FIG. 2 illustrates an example of an image forming apparatus to which an exemplary embodiment of the present invention is applied. Referring to FIG. 2, the following explains how an image forming apparatus operates.

As shown in the drawing, the image forming apparatus includes a photosensitive drum 211 that rotationally operates in a predetermined direction. During the rotation, the photosensitive drum 211 is charged by a first charge roller 213, which is a charging unit, to a predetermined polarity and a predetermined potential. Light is scanned from a light scanning unit 130 to the surface of this charged photosensitive drum 211, for example, a laser beam, and an electrostatic latent image is formed thereon.

The electrostatic latent image formed on the photosensitive drum 211 is developed and visualized by a developing material through a developing roller 215, which is the developing unit.

A recording medium 145, which is driven by a paper feeding roller 141, is loaded on a paper loading plate in a paper feeding cassette, which is housed in a lower portion 143 of the main body 101, and is fed sheet by sheet towards the photosensitive drum 211. The recording medium 145 is provided to a nip (that is, a contact point) between the photosensitive drum 211 and a transfer roller 147. A developed image on the photosensitive drum 211 is sequentially transferred onto the surface of the recording medium 145.

The recording medium 145 with the developed image thereon then passes between a heating roller 210 and a pressing roller 230, which constitute a fixing unit 200, so that the toner is thermally fixed to the recording medium 145. The heating roller 210 and pressing roller 230 may be disposed within a fixing unit housing 201.

After passing through the fixing unit 200, the recording medium 145 is then discharged to a paper delivery tray 181 installed outside a main body 101 of the apparatus through a delivery unit 170.

Figure 3:
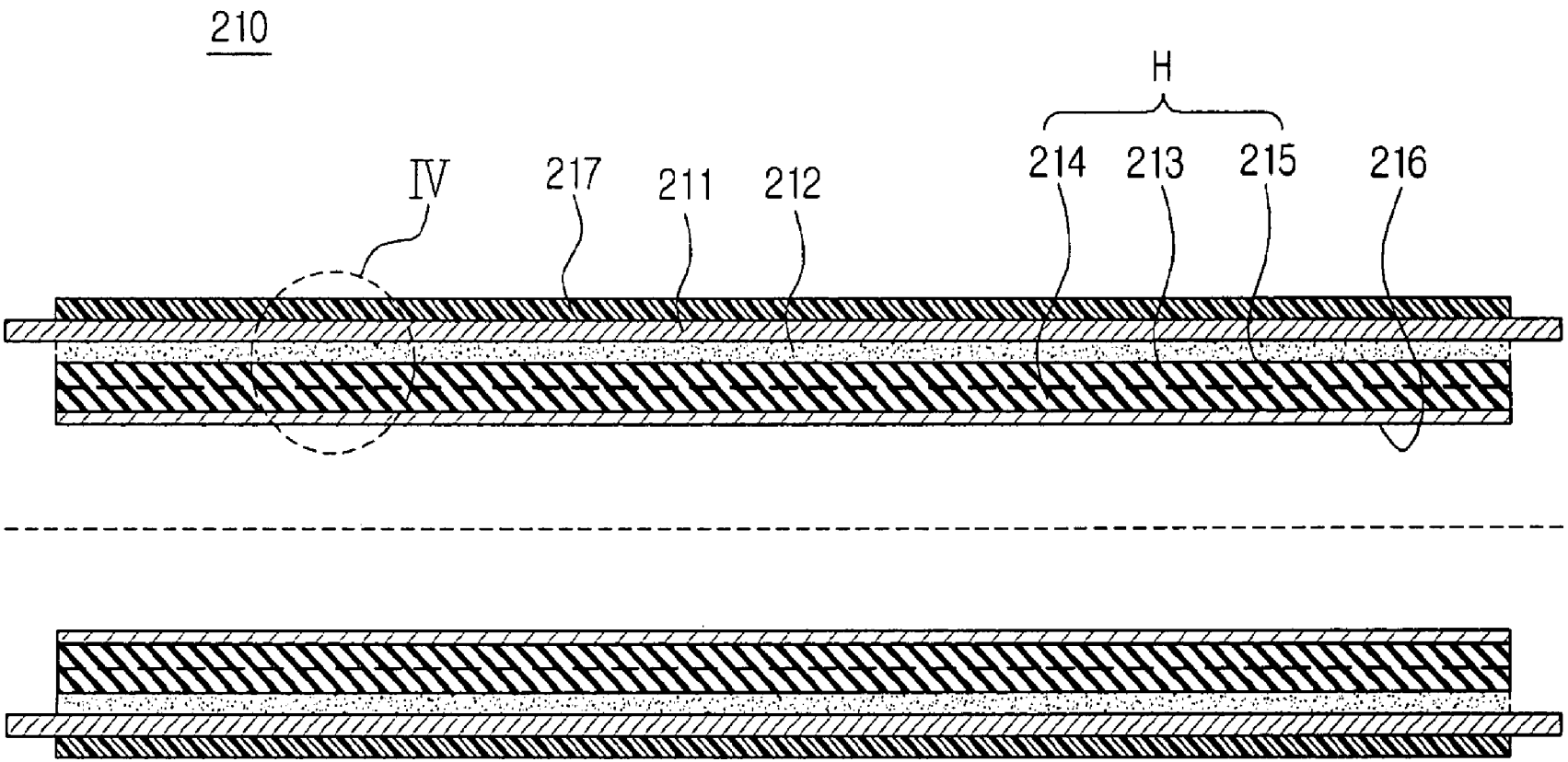
FIG. 3 is an elevational view in cross section of a heating roller according to an exemplary embodiment of the present invention.
Figure 4:
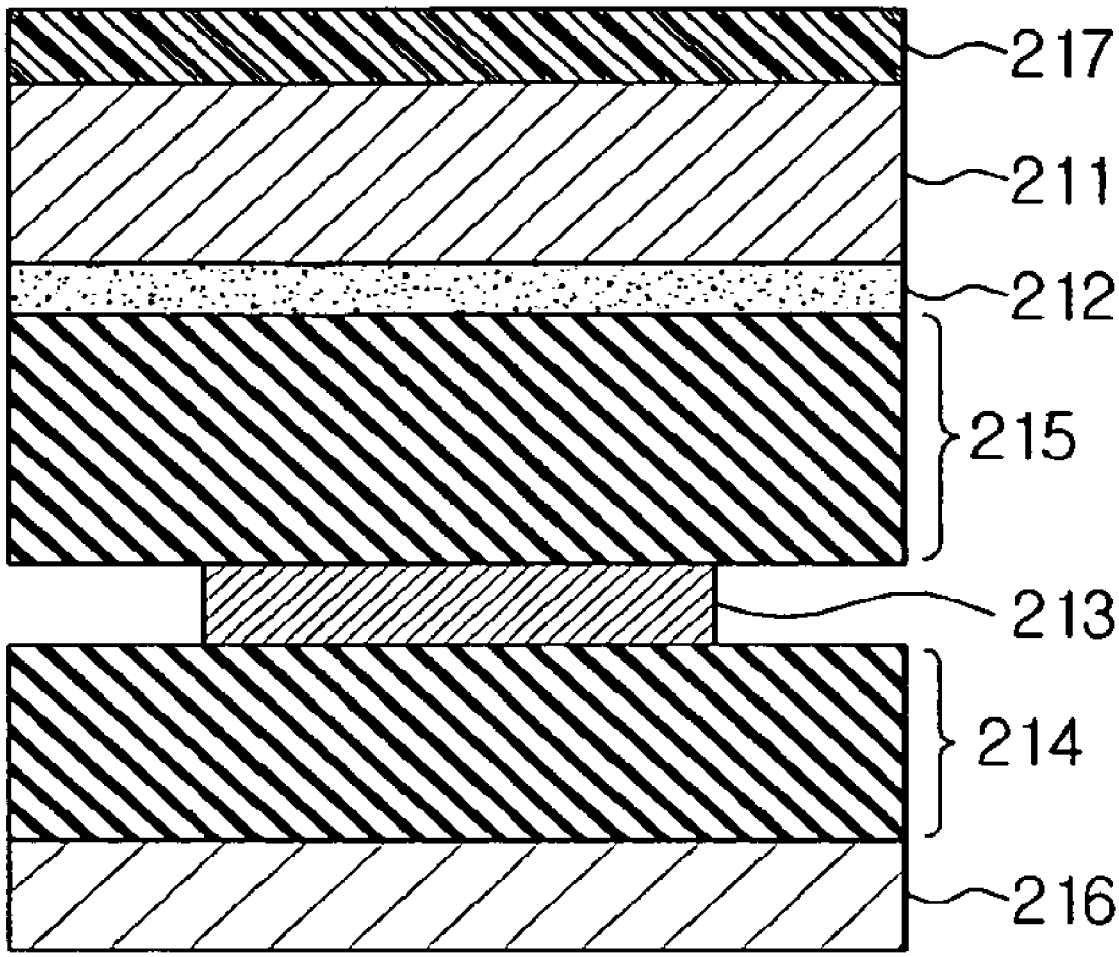
FIG. 4 is an exploded elevational view in cross section of section IV of FIG. 3.

FIG. 3 is an elevational view in cross section of a heating roller according to an exemplary embodiment of the present invention.

Referring to FIG. 3, the heating roller 210 includes an exterior pipe 211, a primer layer 212, a heating coil 213, inner and outer insulating layers 214, 215, and an interior pipe 216.

The exterior pipe 211 is preferably made of aluminum having excellent heat conductibility, and is preferably coated with a polytetrafluoroethylene, such as Teflon, coating layer 217 to substantially prevent toner particles from sticking to the surface of the exterior pipe 211.

The primer layer 212 strongly adheres internal structures H, namely, the heating coil 213, and the inner and outer insulating layers 214 and 215 to the inner surface of the exterior pipe 211, so that the internal structures H may not slip from the inside of the exterior pipe 211.

Generally, the primer layer 212 is made of enamel materials, such as, polyamide, polyimide, AIW (polyamideimide), and urethane. Alternatively, the primer layer 212 may be formed of black paint.

The primer layer 212 composition includes silicon-containing material. Preferably, the silicon-containing material (or group) bonds at a high temperature with silicon resin contained in the exterior insulating layer 215 that is formed of the mica layer. DY-39-051 A or DY-39-051 B, manufactured by Dow Coming Toray Silicone Co., Ltd., may be used for the primer layer 212.

The thickness of the primer layer 212 is preferably less than or equal to approximately 50 μm to minimize heat loss from the heating coil 213.

The heating coil 213 is a resistance heating coil, and is connected to a terminal (not shown) for supplying power. The heating coil 213 is commonly made of nickel and chrome.

The interior pipe 216, similar to the exterior pipe 211, is preferably made of aluminum having excellent heat conductibility. A plastic working may be performed on the interior pipe 216 to provide a predetermined expandability. As a result of this expandability, the internal structures H, namely, the heating coil 213 and the inner and outer insulating layers 214 and 215, are closely adhered to the inner surface of the exterior pipe 211. The chemical change in the primer layer 212 and the physical strength of the interior pipe 216 ensure the internal structures H to be securely adhered to the inner surface of the exterior pipe 211. Although the heating roller 210 may rotate at a predetermined speed, the internal structures H do not slip from the inner surface of the exterior pipe 211.

Table 1 below shows the result of an acceleration test performed on a mono laser printer and a color printer to which the heating roller 210 of an exemplary embodiment of the present invention is applied, respectively.

TABLE 1

| Test set | | No. of printing pages | Resistance change (Ω) before/after the acceleration test, | Occurrence of slipping |
|---|---|---|---|---|
| Mono laser printer | #1 | 100,000 | 44.1 → 44.2 | None |
| | #2 | 100,000 | 44.3 → 44.3 | None |
| | #3 | 100,000 | 44.6 → 44.6 | None |
| | #4 | 100,000 | 44.4 → 44.3 | None |
| Color printer | #5 | 95,000 | 40.1 → 40.2 | None |
| | #6 | 100,000 | 40.3 → 40.3 | None |
| | #7 | 100,000 | 40.1 → 40.1 | None |
| | #8 | 100,000 | 40.5 → 40.5 | None |

As shown in Table 1, rotation of the heating roller for 100,000 sheet printings had a negligible impact on the resistance. This also indicates that the internal structures H did not slip during the rotation of the heating roller.

The foregoing embodiment and advantages are merely exemplary and are not to be construed as limiting the present invention. The present teaching may be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A heating roller, comprising:
an exterior pipe;
a primer layer disposed inside the exterior pipe;
an outer insulating layer disposed inside the primer layer, the outer insulating layer being a Mica layer;
a heating coil disposed inside the outer insulating layer;
an inner insulating layer disposed inside the heating coil; and
an interior pipe disposed inside the inner insulating layer having a predetermined expandability,
wherein the primer layer has a silicon-containing group that binds with silicon (Si) resin contained in the Mica layer at a high temperature.

2. The heating roller according to claim 1, wherein
the inner insulating layer is a Mica layer.

3. The heating roller according to claim 1, wherein
the primer layer is made of an enamel material.

4. The heating roller according to claim 3, wherein
the enamel material is selected from a group consisting of polyamide, polyimide, AIW (polyamideimide), and urethane.

5. The heating roller according to claim 1, wherein
the heating coil is formed of a nickel-chrome layer.

6. The heating roller according to claim 1, wherein
the primer layer has a thickness less than or equal to approximately 50 μm.

7. The heating roller according to claim 1, wherein
the exterior pipe is made of aluminum.

8. The heating roller according to claim 1, wherein
the interior pipe is made of aluminum.

9. An image fixing apparatus, comprising:
a heating roller; and
a pressing roller that contacts the heating roller with a predetermined pressure, and forming a fixing nip portion therebetween;
wherein the heating roller includes
an exterior aluminum pipe coated with a polytetrafluoroethylene layer;
a primer layer disposed inside the exterior aluminum pipe;
an outer insulating layer disposed inside the primer layer, the outer insulating layer being a Mica layer;
a heating coil disposed inside the outer insulating layer;
an inner insulating layer disposed inside the heating coil; and
an aluminum interior pipe disposed inside the inner insulating layer and having predetermined expandability,
wherein the primer layer has a silicon-containing group that binds with silicon (Si) resin contained in the Mica layer at a high temperature.

10. The image fixing apparatus according to claim 9, wherein
the inner insulating layer is a Mica layer.

11. The image fixing apparatus according to claim 9, wherein
the primer layer is made of an enamel material.

12. The image fixing apparatus according to claim 11, wherein
the enamel material is selected from a group consisting of polyamide, polyimide, AIW (polyamideimide), and urethane.

13. The image fixing apparatus according to claim 9, wherein
the heating coil is formed of a nickel-chrome layer.

14. The image fixing apparatus according to claim 9, wherein
the primer layer has a thickness less than or equal to approximately 50 μm.

15. An image forming apparatus comprising an image fixing apparatus for fixing a developed image on a recording medium, wherein the image fixing apparatus comprises:
a heating roller; and
a pressing roller that contacts the heating roller with a predetermined pressure, and
forming a fixing nip portion therebetween;
wherein the heating roller includes
an exterior aluminum pipe coated with a polytetrafluoroethylene layer;

a primer layer disposed inside the exterior aluminum pipe;

an outer insulating layer disposed inside the primer layer, the outer insulating layer being a Mica layer;

a heating coil disposed inside the outer insulating layer;

an inner insulating layer disposed inside the heating coil; and an aluminum interior pipe disposed inside the inner insulating layer and having predetermined expandability wherein the primer layer has a silicon-containing group that binds with silicon (Si) resin contained in the Mica layer at a high temperature.

* * * * *